United States Patent [19]

Byrne et al.

[11] Patent Number: 4,681,597

[45] Date of Patent: Jul. 21, 1987

[54] METHOD FOR AGGLOMERATING POWDERED COAL BY COMPACTION

[76] Inventors: Larry D. Byrne; Barbara J. Byrne, both of R.R. 1, Belle Fourche, S. Dak. 57717

[21] Appl. No.: 273,603

[22] Filed: Jun. 15, 1981

[51] Int. Cl.[4] ..... C10L 5/10

[52] U.S. Cl. ..... 44/15 R; 44/6; 44/10 R; 44/16 R

[58] Field of Search ..... 44/10 R, 6, 15 R, 16 R, 44/2, 11, 10 L; 252/351; 100/104; 264/111

[56] References Cited

U.S. PATENT DOCUMENTS

| | | | |
|---|---|---|---|
| 2,416,476 | 2/1947 | Fuchs | 44/10 R |
| 3,069,293 | 12/1962 | Booth | 44/6 |
| 3,655,350 | 4/1972 | Utley | 44/10 R |
| 4,104,035 | 8/1978 | Cole et al. | 44/51 |
| 4,217,109 | 8/1980 | Siverson et al. | 44/15 R |
| 4,230,460 | 10/1980 | Maust, Jr. | 44/16 C |
| 4,264,333 | 4/1981 | Shaw et al. | 44/6 |

FOREIGN PATENT DOCUMENTS

| | | |
|---|---|---|
| 394572 | 6/1933 | United Kingdom . |
| 650881 | 3/1951 | United Kingdom . |
| 669317 | 4/1952 | United Kingdom . |
| 754632 | 8/1956 | United Kingdom . |
| 798828 | 7/1958 | United Kingdom . |
| 877558 | 9/1961 | United Kingdom . |
| 956039 | 4/1964 | United Kingdom . |
| 1031723 | 6/1966 | United Kingdom . |
| 1073285 | 6/1967 | United Kingdom . |
| 1311392 | 3/1973 | United Kingdom . |
| 1341689 | 12/1973 | United Kingdom . |
| 1469319 | 4/1977 | United Kingdom . |
| 1485526 | 9/1977 | United Kingdom . |
| 1512063 | 5/1978 | United Kingdom . |
| 1564765 | 4/1980 | United Kingdom . |
| 1575413 | 9/1980 | United Kingdom . |

OTHER PUBLICATIONS

Georges Passelecq et al., Ser. No. 382,100, Alein Property Custodian, "Agglomerated Bodies of Carbonaceous Material & Process for Making the Same," Jun. 1, 1943.

*Kirk-Othmer Encyclopedia of Chemical Technology,* 2nd ed. vol. 12, 1967, pp. 371-372 and 813, John Wiley & Sons, Inc.

*The Merck Index,* Eighth Edition, 1968, Merck & Co., Inc., pp. 382-383.

Kingery, D. S., "Some Preliminary Data on Methods for Alloying Coal Dust in Tipples and Cleaning Plants," Aug. 1943, pp. 1-11.

Carl A. Holley, "Agglomeration—The State of the Art," complete article is pertinent.

Carl A. Holley and Joseph M. Antonetti, "Agglomeration of Coal Fines," complete article is pertinent.

Carl A. Holley, "Briquetting and Compacting," complete article is pertinent.

Jason Schneider, *Popular Science,* "Solid Fuel Alternatives," Jan. 1980, pp. 120-122.

*Primary Examiner*—William R. Dixon, Jr.
*Assistant Examiner*—Margaret B. Medley
*Attorney, Agent, or Firm*—Dorsey & Whitney

[57] ABSTRACT

In its method aspect, this invention proposes adding water and small quantities of surfactant, such as dioctyl sodium sulfusuccinate, to powdered carboniferous material in a process for pelletizing the powdered material. In its composition of matter aspect, this invention constitutes the pellets of carboniferous material, water, and surfactant formed by the method.

10 Claims, 1 Drawing Figure

METHOD FOR AGGLOMERATING POWDERED COAL BY COMPACTION

BACKGROUND OF THE INVENTION

1. Field of the Invention

This invention relates to a method for agglomerating powdered carboniferous materials by compaction and, more particularly, relates to a method for agglomerating powdered coal. This invention further relates to a composition of matter consisting of the agglomerated material resulting from application of the method.

2. Description of the Prior Art

Mined coal is used principally as a source of heat energy in power plants. Most of the coal which is shipped to power plants consists of lump or nut coal (i.e. particles which will not pass through a ¾" screen). Power plants pulverize such lump or nut coal upon its receipt and blow the powdered coal into their furnaces. Powdered coal produced by the process of mining or purifying the coal is also shipped to power plants for consumption in their furnaces.

For many years it has been known that powdered coal (i.e. coal dust) is produced in great quantities during the mining of coal, during its handling before and after shipment, and during shipment and storage. This powder is the result of the purely mechanical effects of mining and transporting the coal. It is due as well to weathering and oxidation of stored coal.

Large quantities of powdered coal may also be created by mechanical processes for removing sulfur products from coal. One of the major sources of sulfur in coal is pyrite, which frequently occurs as tiny particles dispersed throughout the coal matrix. Hence, to be cleaned to acceptable levels of sulfur and ash, coal from some mines must be finely ground to liberate pyrite and ash minerals from the coal particles. This operation is followed by separation of the contaminants from the coal by physical (e.g. froth flotation) or chemical processes, which leaves a cleaned coal product in powdered form.

The formation of powdered coal in any of these various ways leads to several significant problems. Coal which is reduced to powder is difficult to ship or use. When powdered coal cannot be shipped or used, its economic value and energy value is totally lost and grinding processes for removing sulfur are useless, unless performed at a power plant site.

Powdered coal (i.e. coal dust) is highly flammable and explosive. Powdered coal may be accidentally ignited while being transported. For example, it may be ignited while being transported on conveyor belts from mines to coal storage warehouses which are suspended above railroad tracks, e.g., by sparks from a railroad car's bad roller bearings.

Powdered coal can also lead to environmental disturbances, including both threats to health and vegetation and aesthetic damage. Powdered coal can permeate the air of mining sites or other work sites, and along transportation routes, should it seep out or blow out of transport vehicles. It can settle on vegetation, in dwellings or anywhere. The problems of black lung are well known; the aesthetic problems are apparent. As coal is shipped greater and greater distances from newly opened mines to old population centers, the exposure of the environment is increased.

Powdered coal is not ordinarily stored; however, it tends to accumulate within various areas of a mine's shipping structures. These structures must be continually washed down and the powdered coal removed before spontaneous combustion occurs. Because of its large surface area, powdered coal reacts with oxygen to produce great amounts of heat. The relative compactness of piles of powder prevents convection currents of air from carrying away heat generated in a pile. Yet, there is generally enough oxygen in ambient air trapped between particles of powder to support spontaneous combustion. As a result, there is a danger of spontaneous combustion when powdered coal accumulates.

Many shipping mines collect coal dust in "bag houses" especially equipped with fans to pull coal dust from the air through collection bags which trap the coal dust. The bags are then shaken down and the coal dust is placed on conveyers to be loaded into railroad cars for shipping. Because of the danger of spontaneous combustion, as little coal dust as possible is stored or stockpiled over long periods of time.

An additional problem is caused merely by the accumulation of coal dust. When coal dust is produced and cannot be collected and used, disposal becomes a problem. Equipment or entire areas may become clogged with the powder. As with any solid waste, disposal must be done in a safe and inexpensive manner.

While the above problems are most familiar in connection with coal, they may also arise in connection with lignite or shale or other carboniferous materials.

At present, certain means and methods exist for dealing with at least some of the above-mentioned problems of powdered coal and other carboniferous materials. Accumulations of powdered coal in storage areas or in shipping areas may be sprayed with water to reduce oxidation and dispersal. Vacuum or air filter systems may be used to collect the powder and reduce its dispersal. Such measures, however, may be ineffective to prevent spontaneous combustion, may do little or nothing about the problem of dispersal, and may be expensive, as illustrated by the use of "bag houses." Such measures also leave the coal in dust form.

It is known to produce blocks or other agglomerated shapes made from particles of certain combustible materials. For example, a pelletized fuel sold under the name Woodex is made from organic vegetable material rich in cellulose, such as wood chips, sawdust, bagasse (sugar cane residue) and corn husks. A process is used on these materials combining high pressure, relatively high temperature and the presence of moisture. Similarly, artificial logs are produced by compressing under high pressure wood waste, such as logged wood, wood chips or coarse sawdust. Coal is a constituent of one such product, made in brick form from hardwood chips and coal chunks held together by an organic resin. Other products, sold under the names Coalex or Coallog, also exist, which are made of coal and a binder consisting of pulverized biomass such as wood chips or other organic waste.

One known process, disclosed in U.S. Pat. No. 4,230,460, issued Oct. 28, 1980, provides for converting powdered coal into pellets by utilizing lime (or limestone or dolomite) and flyash as binders and compressing the resultant mixture. The pellets formed by this process, however, are principally useful as a fuel in fluidized bed combusters. The lime functions as an in-furnace absorbent for sulfur dioxide. The flyash is an inert ingredient which is captured downstream as an undesirable particulate pollutant by electrostatic precipitators or other recovery devices.

A study of the prior art shows that a primary problem in dealing with powdered coal is how to form it into usable larger bodies. Apparatus for agglomerating non-carboniferous materials by compaction are well known and discussed in C. Holley, *BRIQUETTING AND COMPACTING* (distributed by Ferro-Tech, 467 Eureka Road, Wyandotte, Mich. 48192) and C. Holley, *AGGLOMERATION-THE STATE OF THE ART* (distributed by Ferro-Tech, supra), both articles incorporated herein by reference. Another article, C. Holley & J. Antonetti, *AGGLOMERATION OF COAL FINES* (distributed by Ferro-Tech, supra, and presented at the 15th Biennial Conference of IBA, Montreal, Quebec 1977), also incorporated herein by reference, discusses the use of known apparatus and the application known technology to the difficult task of agglomerating fines whose size are less than 28 mesh, e.g. powdered coal.

The latter article discloses that certain extruder apparatus have been utilized for agglomerating by compaction powdered coal having an ambient moisture content up to 30%. However, even with such a high moisture content, a binder has been used, because extruder apparatus generally do not exert enough pressure to force the coal particles to compact and bond together. This indicates that ambient moisture alone does not function well as a binder in the pressure range of such apparatus.

Not only does conventional agglomeration of coal dust by extruder apparatus require a binder, such apparatus have also been of limited use because (1) they are ineffective for handling powdered coal having a low ambient moisture content and (2) the primary sources of powdered coal are bag houses which yield filter cakes having low ambient moisture contents. Extruder apparatus form agglomerated solids, such as pellets, by delivering the powdered coal to a die through which it is compressed. Powdered coal having a low moisture content is difficult to convey and control. It easily becomes airborne dust and can lead to explosion danger, especially around such compacting apparatus. Also, powdered coal having a low moisture content will not flow readily through a die but rather tends to pack and degrade the die. Finally, powdered coal having a low moisture content, such as filter cake coal taken from a bag house, is not easily moistened because water does not mix well with relatively dry powdered coal.

The Holley and Antonetti article further indicates that the greatest success in agglomerating powdered coal has been achieved in several "dry" processes. A briquette compactor and a disc pelletizer (the latter apparatus being an agitator rather than a compactor) have been used, employing binders such as lignosulfonate, bentonite, tar, pitch, and fuel oil. The principal disadvantages to the use of these two types of apparatus lie in the cost of the apparatus and their operation, as well as the cost of the binders used in the process. Moreover, the dry powdered coal presents a significant handling problem here also, in that it easily becomes airborne dust and can explode.

In summary, conventional coal agglomeration processes utilize pulverized or lump coal, and none of them produce pellets or bricks principally from powdered coal. The known processes involve use of significant quantities of binders, and some processes require complex agglomeration steps involving heat and pressure. To the extent such processes could be used as a partial solution to the problems caused by powdered coal, they appear to involve significant expense. Moreover, some of the processes produce products of limited use. The pellets produced according to the process disclosed in U.S. Pat. No. 4,230,460 are principally useful in fluidized bed combusters and result in a significant increase in flyash pollution. Other products are designed primarily for home fireplace use.

SUMMARY OF THE INVENTION

The present invention involves a method for agglomerating by compaction powdered carboniferous material comprising the steps of: (a) mixing (1) powdered carboniferous material with (2) an amount of surfactant effective for wetting the powdered carboniferous material with water but for which no appreciable binding occurs between the surfactant and carboniferous material upon compaction and (3) an amount of water effective to bring the moisture content of the resultant mixture within the range of about 32 to 35% by weight; (b) working the mix to obtain a homogeneous composition comprising a uniform dispersion of the water, surfactant, and powdered carboniferous material; and (c) compacting the resultant homogeneous composition into the desired solid product shape. The present invention further involves the homogeneous composition compacted into a solid product having a shape suitable for handling, transporting and burning.

The method of the present invention overcomes several inherent problems in forming solid products from powdered carboniferous materials without the aid of a binder, especially when forming such solid products by using a conventional compaction apparatus. For example, conventional pellet mills form pellets by extruding a powder through a ring die, thereby continuously forming pellets by compressing the powder. The problems inherent in using extrusion die pellet mills to form coal pellets are that dry powdered coal will pack a die and fail to extrude; ambient water moisture in powdered coal does not function well as a binder, with the result that pellets break apart easily; powdered coal having a low moisture content easily becomes airborne and explosive; and powdered coal is not easily converted into a homogeneous, extrudable material. Other conventional apparatus for compacting powdered materials, such as roll briquetters, roll compactors, screw extruders, eccentric piston extruders, hydraulic piston briquetters, and other, also suffer from similar problems. For example, briquetters compact powder by bringing two dies together with great pressure. Without the use of binders or lubricants, the powder will often pack the dies. Moreover, rapid operation of the apparatus will tend to blow the powder being fed into the compactor into the air, thereby creating risk of explosion.

The present invention teaches that a wetting agent or surfactant can aid in the handling of powdered carboniferous material for extrusion and other processes. The surfactant is used to make a wetting solution. The solution used to wet powdered carboniferous material should, however, not be so expensive as to be commercially prohibitive and must not interfere with or adversely affect combustion properties of the resulting solid product, either with respect to the heat derived from such combustion or environmental restrictions on combustion by-products. Water is a prime candidate for wetting powdered carboniferous material, because it is not particularly expensive and water vapor as a by-product of combustion creates no environmental hazard. Furthermore, if the water content of the resultant solid product can be kept sufficiently low or the solid product dried economically, the heat loss during combustion due to converting the water in the solid product to water vapor need not be so wasteful as to be commercially prohibitive.

Water alone, however, does not mix well with powdered carboniferous materials. For example, mixing reasonable quantities of water to powdered coal generally results in an uneven distribution of the water through the powdered coal. Even when a potential binder such as molasses or tar is added to the water, the resulting heterogeneous mixture generally consists of sticky balls of coal among unwetted powder. Such heterogeneous mixtures present handling problems similar to those discussed above, and if a solid product can be made, it will degrade and break apart easily in the absence of an effective binder. Thus, until the present invention, water-based solutions have not been used to wet powdered carboniferous materials for the purpose of compressing the material into pellets or other usefully shaped solids.

With the present invention, a uniform dispersion of water in powdered coal is made by use of a surfactant, and the handling problems normally attending powdered coal are obviated. The risk of explosion is reduced, because, when wetted in this manner, the coal dust does not become airborne. Equally important, the uniformly dispersed water moisture functions as a lubricant, thereby preventing the die(s) of a compactor from becoming packed. The wetted powder will extrude through ring dies, thus making available for compaction of powdered coal the most economical type of compactor. Finally, the uniformly dispersed water sufactant solution functions as an effective binder, in contrast to the hetrogeneous mixtures discussed above, enabling the production of durable solid products suitable for transportation and handling.

The principal objects of the present invention are as follows: (a) to provide a method for processing powdered coal or other powdered carboniferous material so that it can be recovered as fuel; (b) to provide a method of reducing environmental disturbances caused by mining, transporting and handling powdered carboniferous material; (c) to provide a method for transforming powdered carboniferous material into a solid product form having reduced susceptibility to oxidation and spontaneous combustion; (d) to provide a process for disposal of powdered carboniferous material by recovering it as a solid product which may be conveniently handled, transported and used as fuel; and, (e) to provide a method for compacting powdered carboniferous material without the aid of costly binders.

DESCRIPTION OF THE PREFERRED EMBODIMENT

Figure 1:
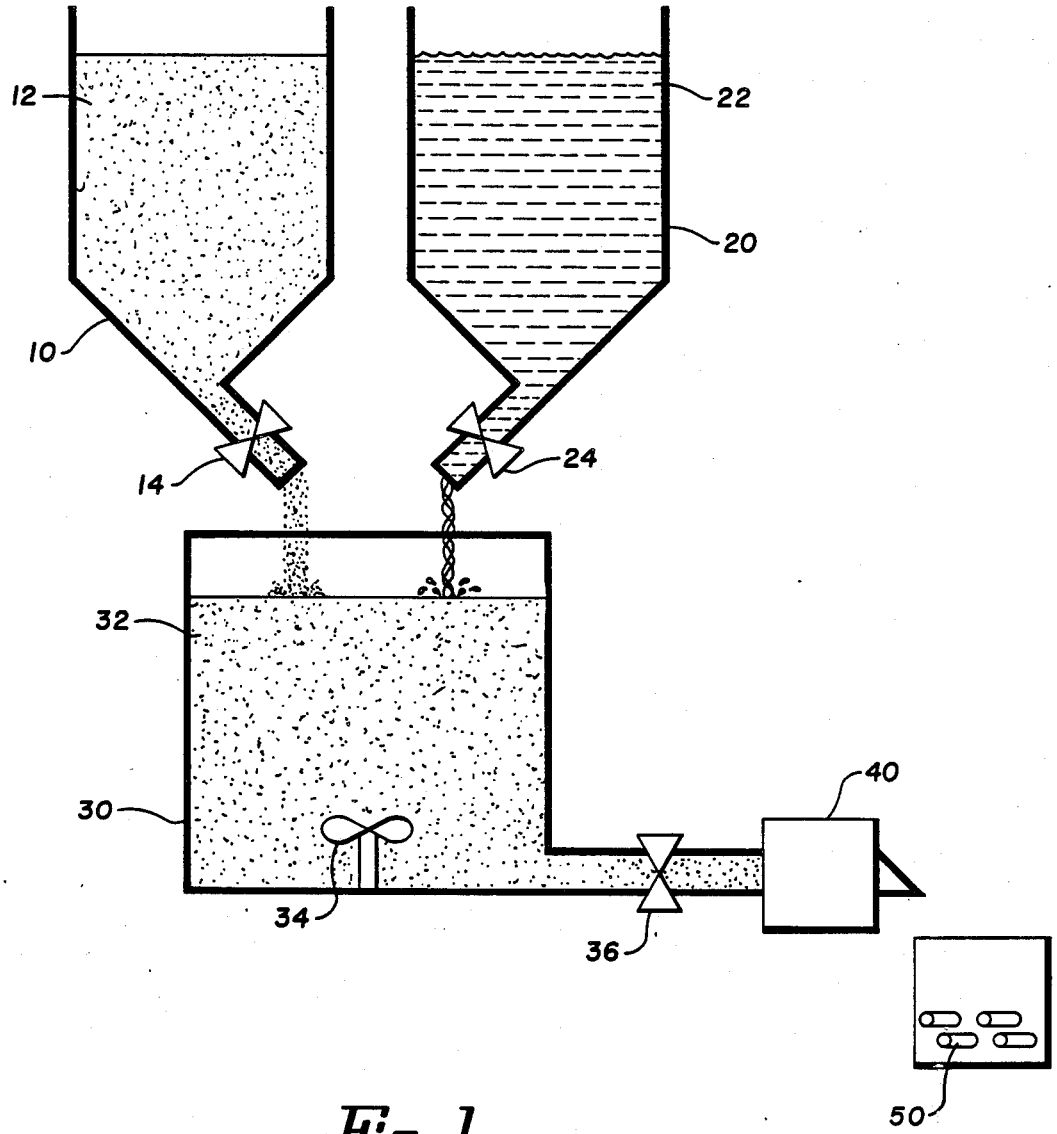
FIG. 1 is a schematic drawing depicting the process of the present invention.

The preferred embodiment of the present invention is illustrated by reference to FIG. 1. Powdered carboniferous material 12, contained in bin 10, may be virtually dry or may contain ambient water moisture, including moisture from dust and combustion control procedures. The powder 12 might also contain ambient moisture as a result, for example, of humidity, rain, or of mining procedures involving the use of water. The ambient water moisture content in powder 12 can be determined by conventional means. One method is to bake off the moisture in a test sample of powder 12 and determine the weight loss. Another method is use of a conventional grain moisture sensor.

Solution 22 of water and a surfactant, dioctyl sodium sulfusuccinate in the preferred embodiment, is contained in bin 20. Dioctyl sodium sulfusuccinate (or dioctyl ester of sodium sulfo succinic acid) is available commercially under the name Aerosol OT from American Cyanamid & Chemical Company. Powder 12 and solution 22 are metered into mixer 30 by respective means 14 and 24, at a rate sufficient to yield a homogeneous composition 32 having a moisture content of about 32–35% by weight in the case of compaction by a ring extruder. Thus, the amount of water, as a constituent of solution 22, added through means 24 complements the moisture of powder 12 resulting from ambient moisture to yield a total moisture content under the present example of about 32–35% by weight. This range of final moisture content is desirable because it represents a balance between a high moisture content which aids in forming pellets by extrusion dies and a low moisture content which is helpful in avoiding excessive heat loss upon combustion of pellets 50 due to converting the water moisture contained in pellets 50 into water vapor. Of course, coal pellets will dry somewhat after the extrusion process, thereby lowering their moisture content. Further drying may be accomplished by heating the pellets, as in a fluidized bed dryer.

Solution 22 contains dioctyl sodium sulfusuccinate at a concentration sufficient to yield about 45 to about 50 grams of dioctyl sodium sulfusuccinate per 1,000 kilograms of homogeneous composition 32. The desired concentration of dioctyl sodium sulfusuccinate in solution 22 can be calculated based upon the respective flow rates of powder 12 and solution 22 through metering means 14 and 24.

Powder 12 and solution 22 are mixed to form homogeneous composition 32 by any suitable agitating means 34 such as a stirring blade. Homogeneous composition 32 is metered to pelletizer means 40 including an extruder die by metering means 36, resulting in pellets 50.

One type of ring extruder which has been found suitable for carrying out the mixing and pellet-forming steps of the above process is the Series 6000 pellet mill made by California Pellet Mill Co., of San Francisco, Calif. This type of equipment is frequently used for pelletizing grains, but it can be adapted to carry out the process of the present invention by certain modifications. In particular, coal dust is augered directly into the pellet mill's mixing bin. The pneumatic scale is bypassed, as are the feed table and the hammer mill portions of the pellet mill. The cyclone in the apparatus would also not be used. Dies of various sizes can be used with this pellet mill. While pellets can be produced which are cylindrical and have a cross-sectional diameter of approximately three-fourths of an inch, in the preferred embodiment it has found that pellets with a diameter of three-eighths of an inch can be produced with greater uniformity and speed.

One specific example of the process of the present invention is as follows. The aqueous surfactant solution was prepared by mixing one ounce of a seventy-five percent by volume aqueous solution of Aerosol OT with twenty-five gallons of water. Eighteen to twenty gallons of the resulting solution was mixed with approximately one thousand pounds of coal dust from relatively low-grade bituminous or soft coal from the eastern Wyoming area. The resulting mixture was agitated in the mixing bin of a Series 6000 California Pellet Mill Co. mill and extruded through a three-eighths inch diameter ring die at a pressure of approximately twelve to fifteen thousand pounds. The result was approximately one thousand pounds of pellets having a moisture content of around thirty-two percent at the time of extrusion. These pellets were found to have essentially the same BTU content as the coal from which they were made.

In its composition of matter aspect, the preferred embodiment of the present invention involves homogeneous composition 32 compressed into a solid product having the shape of a cylindrical pellet. Such pellets 50 can be transported or burned immediately after their production. On the other hand, when allowed to dry, pellets 50 will lose some of their moisture. For example, during one test pellets were allowed to dry for four to five hours resulting in a moisture content of 21%. This loss of moisture did not weaken the pellets but rather strengthened the pellets as measured by their capacity to maintain their shape against efforts to break up the pellets. Finally, pellets 50 may be stockpiled without fear of spontaneous combustion even though some of their water moisture might evaporate upon storage.

Alternatives to the above preferred embodiment are, of course, possible. Any substance which is a surface acting agent for water with respect to powdered carboniferous material could be substituted for dioctyl sodium sulfusuccinate. Any wetting agent which breaks down the surface tension of water or any detergent or emulsifier would work as the surfactant for the purposes of this invention. Examples include sodium lauryl sulfate, sodium oleyl sulfate, sodium salt of sulfonated lauryl and myristyl collamide (marketed under the trademark INTRAMINE by Synthetic Chemicals, Inc., Jersey City, N.J.), sulfonated fatty amine (marketed under the trademark NOPCO DID by National Oil Products Co., Harrison, N.J.), sulfated fatty alcohol (marketed under the trademarks MAPROFIX, MAPROMIN and MAPROMOL by Onyx Oil & Chemical Co., Jersey City, N.J.), and sulfonated amide (marketed under the trademark ORATOL W-1335 by Jacques Wolf & Co.). Further examples of wetting agents, detergents, and emulsifiers which would work as the surfactant for the purposes of this invention are listed on pages 117–154 of C. Young & K. Coons, *SURFACE ACTIVE AGENTS-THEORETICAL ASPECTS AND APPLICATIONS* (Chemical Publishing House 1945), incorporated herein by reference. Dioctyl sodium sulfusuccinate was chosen for the preferred embodiment because of its relatively low cost and ready availability.

As further alternatives to the preferred embodiment, homogeneous composition 32 may be compressed into any shape or size that is suitable for handling, transporting and burning. Although the optimal moisture content of the compressed homogeneous composition compressed by a ring extruder as measured immediately after pelletizing is within the range of 32–35% by weight, other higher or lower moisture contents near this range are practical. As mentioned, the compressed homogeneous composition will generally tend to lose some moisture upon storage or baking, depending on atmospheric humidity conditions.

Moreover, the basic method for forming solid product shapes from powdered carboniferous material includes the step of compacting the homogeneous composition. This latter step may be realized by various means in addition to the extrusion die pellet mills discussed above in connection with the preferred embodiment. Other means useful for compacting powdered carboniferous materials into solid products without the aid of binders similarly benefit from the use of a wetting solution. These other means include, but are not limited to, roll briquetters, roll compactors, screw extruders, eccentric piston extruders, and hydraulic piston briquetters. The particular means used for compacting the homogeneous composition is secondary in importance to the discovery that the process of compacting powdered carboniferous materials such as powdered coal can be facilitated by wetting the material with water by use of an effective surfactant. Such wetting aids the handling of the powder and it apparently allows the water to function as a more effective binder. The optimal moisture content of the homogeneous composition might vary depending upon the particular means employed in compacting such material.

Having described the invention, what is claimed as new and desired to be secured by Letters Patent is:

1. A method for preparing a powdered carboniferous composition and forming this composition into solid product shapes suitable for handling, transporting and burning, comprising the steps of:

(a) mixing (1) powdered carboniferous material with (2) an amount of surfactant effective for wetting the powdered carboniferous material with water but for which no appreciable binding occurs between the surfactant and carboniferous material upon compaction and (3) an amount of water effective to bring the moisture content of the resultant mixture within the range of about 32 to 35% by weight;

(b) working the mixture to obtain a homogeneous composition comprising a uniform dispersion of the water, surfactant, and powdered carboniferous material; and (c) compacting the resultant homogeneous composition into the desired solid product shape by extruding the homogeneous composition through a ring pelletizing extruder.

2. The method of claim 1 wherein the homogeneous composition is compacted into a solid product having the shape of a cylindrical pellet.

3. The method of claim 1 wherein the powdered carboniferous material comprises powdered coal.

4. The method of claim 2 wherein the surfactant is dioctyl sodium sulfusuccinate.

5. The method of claim 3 wherein the amount of dioctyl sodium sulfusuccinate added is within the range of about 45 to about 50 grams per 1,000 kilograms of homogeneous composition.

6. A homogeneous composition compacted into a solid product by extruding the homogeneous composition through a ring pelletizing extruder, the solid product having a shape suitable for handling, transporting and burning, comprising carboniferous material, an amount of surfactant effective for wetting powdered carboniferous material with water but for which no appreciable binding occurs between the surfactant and carboniferous material upon compaction, and an amount of water equal to about 32 to 35% by weight of the homogeneous composition, said water and surfactant being uniformly dispersed throughout the carboniferous material.

7. The compacted homogeneous composition of claim 6 wherein the solid product has the shape of a cylindrical pellet.

8. The compacted homogeneous composition of claim 6 wherein the carboniferous material is coal.

9. The compacted homogeneous composition of claim 8 wherein the surfactant is dioctyl sodium sulfusuccinate.

10. The compacted homogeneous composition of claim 9 wherein the amount of dioctyl sodium sulfusuccinate is within the range of about 45 to about 50 grams per 1,000 kilograms of homogeneous composition.

* * * * *